US008499497B1

(12) United States Patent
Hugueley

(10) Patent No.: US 8,499,497 B1
(45) Date of Patent: Aug. 6, 2013

(54) CRAWL SPACE VENT COVER ASSEMBLY

(71) Applicant: Jason W. Hugueley, Dyersburg, TN (US)

(72) Inventor: Jason W. Hugueley, Dyersburg, TN (US)

( * ) Notice: Subject to any disclaimer, the term of this patent is extended or adjusted under 35 U.S.C. 154(b) by 0 days.

(21) Appl. No.: 13/677,403

(22) Filed: Nov. 15, 2012

(51) Int. Cl.
*E06B 3/32* (2006.01)

(52) U.S. Cl.
USPC ..... 49/463; 49/466

(58) Field of Classification Search
USPC ..... 49/463, 465, 466; 52/198, 199, 52/302.1, 302.7, 514, 202, 203
See application file for complete search history.

(56) References Cited

U.S. PATENT DOCUMENTS

| | | | | | |
|---|---|---|---|---|---|
| 14,680 | A | * | 4/1856 | Titus | 404/26 |
| 88,386 | A | * | 3/1869 | Cleef | 49/465 |
| 3,130,659 | A | * | 4/1964 | Compton et al. | 454/276 |
| 3,211,042 | A | * | 10/1965 | Fischer | 411/344 |
| 3,605,547 | A | * | 9/1971 | Millet | 411/344 |
| 4,297,823 | A | * | 11/1981 | Keisler | 52/514 |
| 4,712,343 | A | | 12/1987 | Dearing et al. | |
| 5,007,223 | A | * | 4/1991 | Holland | 52/745.21 |
| 5,018,331 | A | * | 5/1991 | Forzano | 52/514 |
| 5,058,519 | A | * | 10/1991 | Collins | 114/227 |
| 5,073,075 | A | * | 12/1991 | Duran | 411/552 |
| 5,669,190 | A | * | 9/1997 | Szyjkowski | 52/196 |
| 5,966,876 | A | * | 10/1999 | Neathery et al. | 52/20 |
| D446,317 | S | | 8/2001 | Jackson et al. | |
| 6,378,263 | B1 | * | 4/2002 | Sobers | 52/514 |
| 6,508,040 | B2 | * | 1/2003 | Nelson | 52/514 |
| 6,594,967 | B1 | * | 7/2003 | Panahii | 52/514 |
| 6,749,499 | B1 | | 6/2004 | Snyder | |
| 6,835,129 | B1 | | 12/2004 | Harris | |
| 7,469,502 | B1 | * | 12/2008 | Steel | 49/465 |
| D607,098 | S | | 12/2009 | Sykes | |
| 7,707,789 | B2 | * | 5/2010 | Janesky | 52/169.6 |
| 7,794,313 | B2 | | 9/2010 | Ruberg | |
| 2002/0069599 | A1 | | 6/2002 | Dhallan | |
| 2005/0086889 | A1 | * | 4/2005 | Shock | 52/514 |
| 2011/0146162 | A1 | * | 6/2011 | Kilhams | 49/463 |
| 2013/0098297 | A1 | * | 4/2013 | Chen et al. | 119/51.01 |

* cited by examiner

*Primary Examiner* — Jerry Redman

(57) ABSTRACT

A crawl space vent cover assembly seals a crawl space vent during cold weather. The assembly includes a panel and an aperture extending through the panel. A line is slidably inserted through the aperture. A hook is coupled to a first end of the line for coupling to a louvered vent coupled to a vent opening. A second end of the line extends from a second surface of the panel. Pulling the second end of the line urges the hook towards a first surface of the panel such that the panel is drawn to abut a wall surface surrounding the vent opening. A retention member is coupled to the line between the second end of the line and the second surface of the panel and is positionable against the second surface of the panel to hold the panel against the wall surface.

9 Claims, 4 Drawing Sheets

CRAWL SPACE VENT COVER ASSEMBLY

BACKGROUND OF THE DISCLOSURE

1. Field of the Disclosure

The disclosure relates to vent cover devices and more particularly pertains to a new vent cover device for covering and sealing a crawl space vent during cold weather to insulate the crawl space.

2. Summary of the Disclosure

An embodiment of the disclosure meets the needs presented above by generally comprising a panel having a first surface, a second surface and a perimeter edge extending around the panel. An aperture extends through the panel and a line is slidably inserted through the aperture. A hook is coupled to a first end of the line for coupling to a louvered vent coupled to a vent opening. A second end of the line extends from the second surface of the panel. Pulling the second end of the line urges the hook towards the first surface of the panel such that the panel is drawn to abut a wall surface surrounding the vent opening. A retention member is coupled to the line between the second end of the line and the second surface of the panel and is positionable against the second surface of the panel to hold the panel against the wall surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
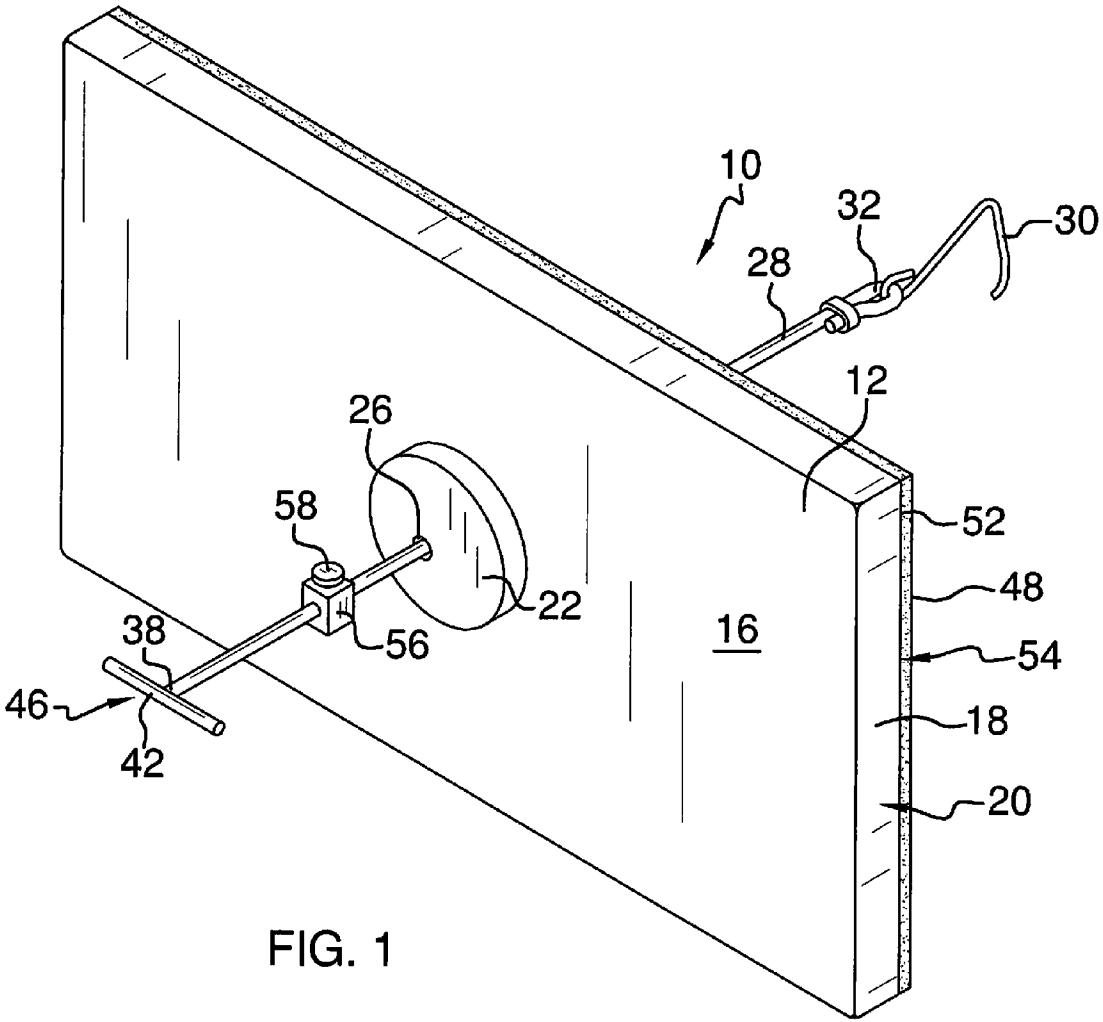
FIG. 1 is a top front side perspective view of a crawl space vent cover assembly according to an embodiment of the disclosure.
Figure 2:
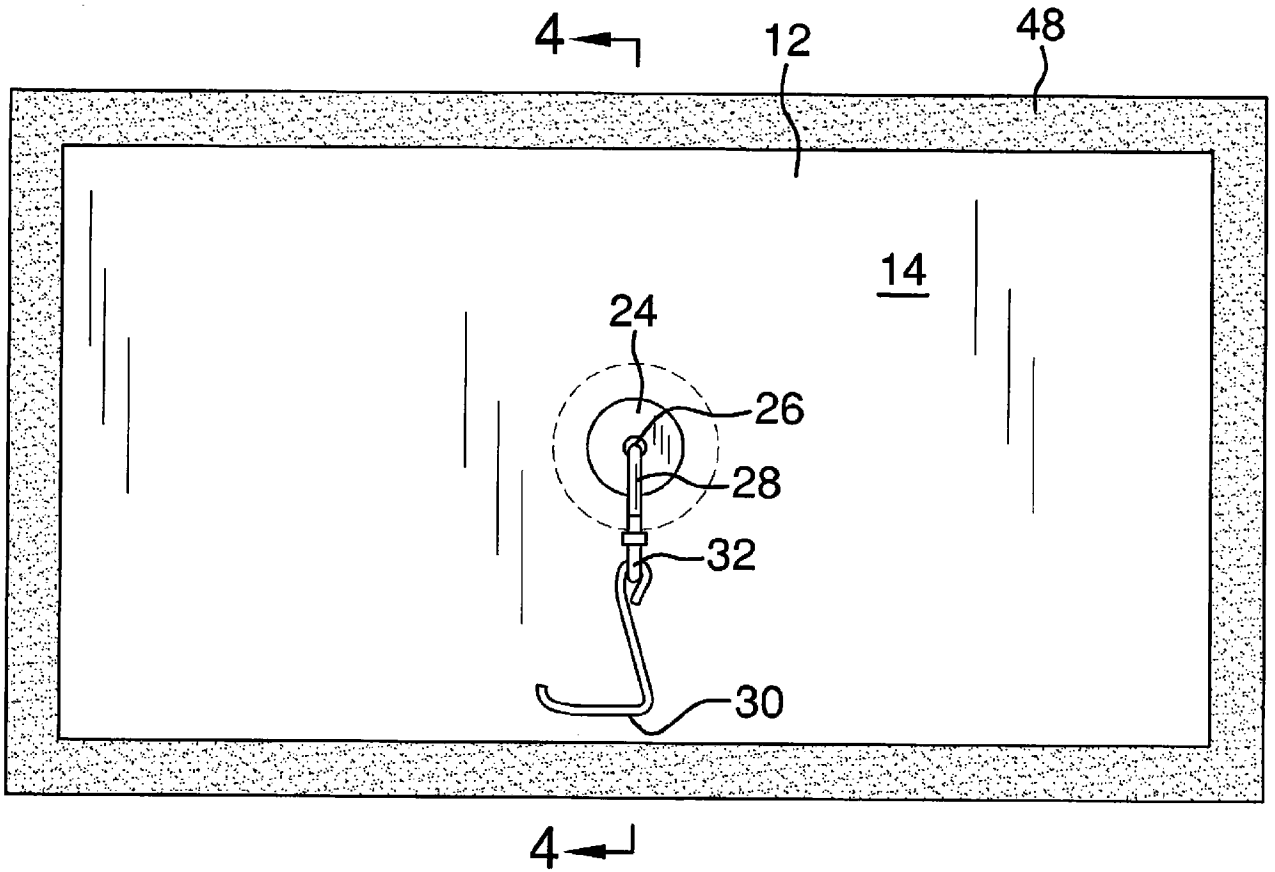
FIG. 2 is a back view of an embodiment of the disclosure.
Figure 4:
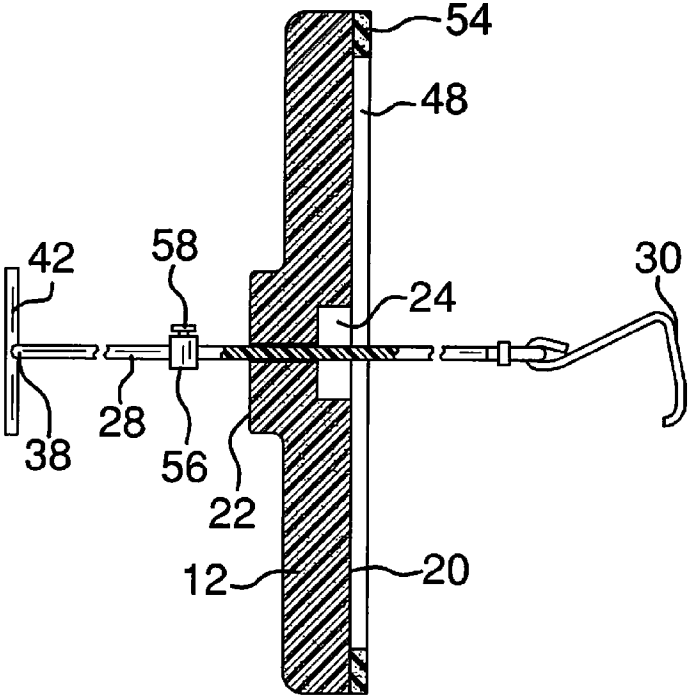
FIG. 4 is a cross-sectional view of an embodiment of the disclosure taken along line 4-4 of FIG. 2.
Figure 3:
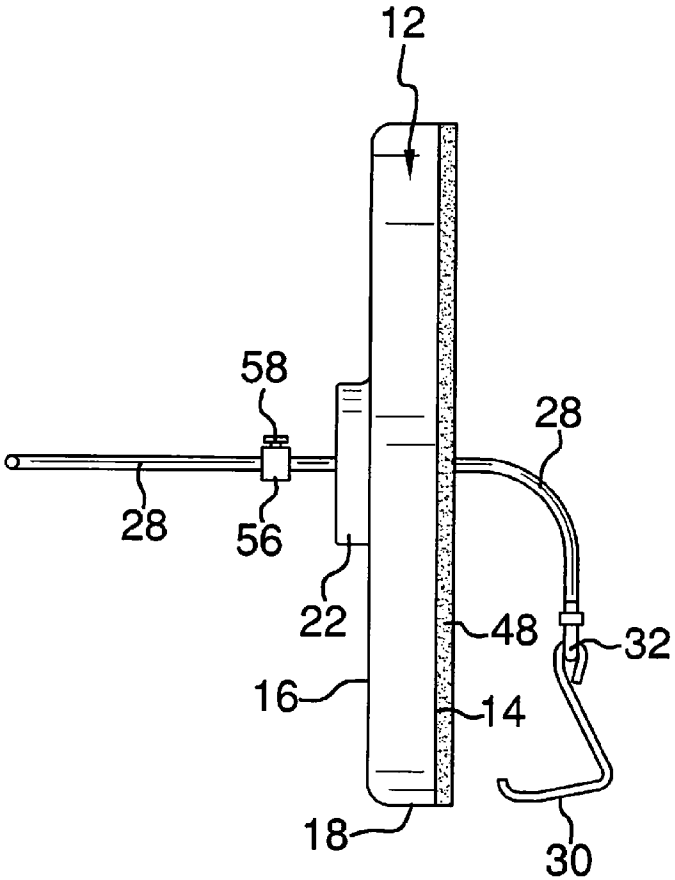
FIG. 3 is a side view of an embodiment of the disclosure.
Figure 5:
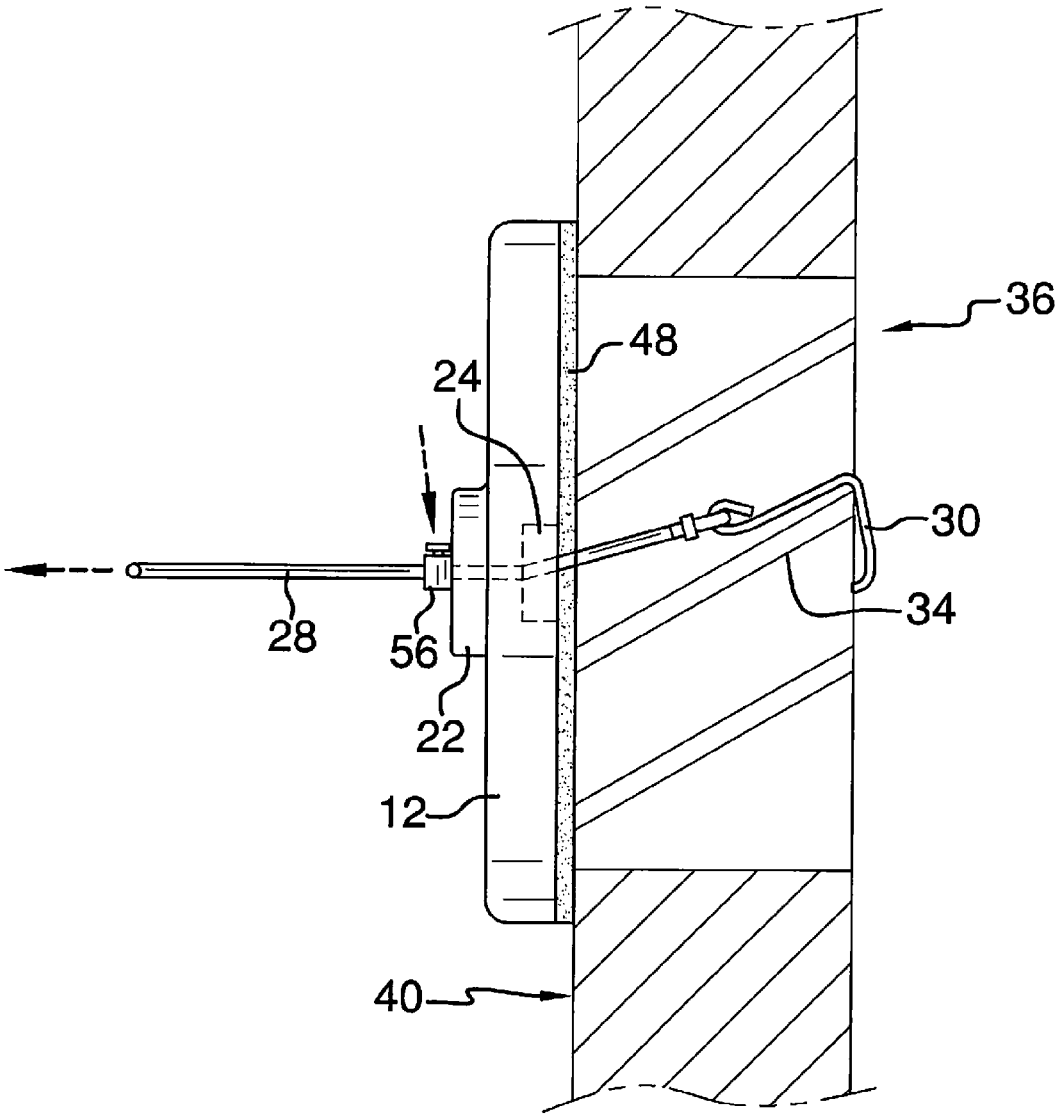
FIG. 5 is a side view of an embodiment of the disclosure in use.

With reference now to the drawings, and in particular to FIGS. 1 through 5 thereof, a new vent cover device embodying the principles and concepts of an embodiment of the disclosure and generally designated by the reference numeral 10 will be described.

As best illustrated in FIGS. 1 through 5, the crawl space vent cover assembly 10 generally comprises a panel 12 having a first surface 14, a second surface 16 and a perimeter edge 18 extending around the panel 12. The panel 12 may be constructed of a high density foam material 20. The second surface 16 of the panel 12 may have a raised medial section 22. A cavity 24 extends into the first surface 14 of the panel 12 opposite the raised medial section 22. An aperture 26 extends through the panel 12 between the first surface 14 and the second surface 16. The aperture 26 extends through the raised medial section 22 of the second surface 16 of the panel 12. The aperture 22 extends through the cavity 24. A line 28 is slidably inserted through the aperture 22 wherein the line 28 extends from the raised medial section 22 of the second surface 16 of the panel 12. A hook 30 is coupled to a first end 32 of the line 28. The hook 28 is configured to couple to a louvered vent 34 coupled to a vent opening 36. A second end 38 of the line 28 extends from the second surface 16 of the panel 12. Pulling the second end 38 of the line 28 urges the hook 30 towards the first surface 14 of the panel 12 such that the panel 12 is drawn to abut a wall surface 40 surrounding the vent opening 36.

A handle 42 may be coupled to the second end 38 of the line 28. The handle 42 may be a straight member 46 and the second end 38 of the line 28 may be attached to a middle of the straight member 46.

A gasket 48 may be coupled to the first surface 14 of the panel 12. The gasket 48 extends around a perimeter edge 52 of the first surface 14 of the panel 12. The gasket 48 may be constructed of a rubber material 54.

A retention member 56 is coupled to the line 28 between the second end 38 of the line 28 and the second surface 16 of the panel 12. The retention member 56 is positionable against the second surface 16 of the panel 12 wherein panel 12 is held against the wall surface 40. A release button 58 is coupled to the retention member 56. The release button 58 disengages the retention member 56 from the line 28 when the release button 58 is depressed. Thus, the retention member 56 is positionable at a selectable position along the line 28 when the release button 58 is depressed.

In use, the hook 30 is inserted through the louvered vent 34. The hook 30 engages the vent 34 and the second end 38 of the line 28 is pulled tight and the retention member 56 is slid against the second surface 16 of the panel 12. The release button 58 is released when the retention member 56 abuts the second surface 16 of the panel 12. The retention member 56 is then secured in place on the line 28 and the panel 12 is held in tension against the wall surface 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A crawl space vent cover assembly comprising:

a panel having a first surface, a second surface and a perimeter edge extending around said panel;

an aperture extending through said panel between said first surface and said second surface;

a line slidably inserted through said aperture;

a hook coupled to a first end of said line, said hook being configured to couple to a louvered vent coupled to a vent opening;

a second end of said line extending from said second surface of said panel wherein pulling said second end of said line urges said hook towards said first surface of said panel such that said panel is drawn to abut a wall surface surrounding the vent opening; and a retention member coupled to said line between said second end of said line and said second surface of said panel, said retention member being positionable against said second surface of said panel wherein said panel is held against the wall surface.

2. The assembly of claim 1, further comprising a handle coupled to said second end of said line.

3. The assembly of claim 1, further comprising a gasket coupled to said first surface of said panel, said gasket extending around a perimeter edge of said first surface of said panel.

4. The assembly of claim 3, further comprising said gasket being constructed of a rubber material.

5. The assembly of claim 1, further comprising a release button coupled to said retention member, said release button disengaging said retention member from said line when said release button is depressed wherein said retention member is positionable at a selectable position along said line when said release button is depressed.

6. The assembly of claim 1, further comprising a cavity extending into said first surface of said panel, said aperture extending through said cavity.

7. The assembly of claim 1, further comprising said second surface of said panel having a raised medial section, said aperture extending through said raised medial section wherein said line extends from said raised medial section of said second surface of said panel.

8. The assembly of claim 1, further comprising said panel being constructed of a high density foam material.

9. A crawl space vent cover assembly comprising:

a panel having a first surface, a second surface and a perimeter edge extending around said panel, said panel being constructed of a high density foam material, said second surface of said panel having a raised medial section;

a cavity extending into said first surface of said panel;

an aperture extending through said panel between said first surface and said second surface, said aperture extending through said raised medial section wherein said line extends from said raised medial section of said second surface of said panel, said aperture extending through said cavity;

a line slidably inserted through said aperture wherein said line extends from said raised medial section of said second surface of said panel;

a hook coupled to a first end of said line, said hook being configured to couple to a louvered vent coupled to a vent opening;

a second end of said line extending from said second surface of said panel wherein pulling said second end of said line urges said hook towards said first surface of said panel such that said panel is drawn to abut a wall surface surrounding the vent opening;

a handle coupled to said second end of said line;

a gasket coupled to said first surface of said panel, said gasket extending around a perimeter edge of said first surface of said panel, said gasket being constructed of a rubber material;

a retention member coupled to said line between said second end of said line and said second surface of said panel, said retention member being positionable against said second surface of said panel wherein said panel is held against the wall surface; and a release button coupled to said retention member, said release button disengaging said retention member from said line when said release button is depressed wherein said retention member is positionable at a selectable position along said line when said release button is depressed.

* * * * *